US008098545B2

(12) United States Patent
Rhodes et al.

(10) Patent No.: US 8,098,545 B2
(45) Date of Patent: Jan. 17, 2012

(54) UNDERWATER VEHICLE GUIDANCE

(75) Inventors: Mark Rhodes, West Lothian (GB); Brendan Hyland, Edinburgh (GB)

(73) Assignee: WFS Technologies Ltd., Edinburgh (GB)

( * ) Notice: Subject to any disclaimer, the term of this patent is extended or adjusted under 35 U.S.C. 154(b) by 420 days.

(21) Appl. No.: 12/366,879

(22) Filed: Feb. 6, 2009

(65) Prior Publication Data

US 2010/0107958 A1 May 6, 2010

(30) Foreign Application Priority Data

Nov. 3, 2008 (GB) ..... 0820097.4

(51) Int. Cl.
*H04B 11/00* (2006.01)
*G01S 15/00* (2006.01)
*G01S 13/00* (2006.01)

(52) U.S. Cl. ..... 367/131; 342/66; 367/99; 367/133

(58) Field of Classification Search ..... 367/95–97, 367/99, 107, 131, 133; 342/66; 348/113–114
See application file for complete search history.

(56) References Cited

U.S. PATENT DOCUMENTS

| | | | | |
|---|---|---|---|---|
| 2,759,783 | A * | 8/1956 | Ross | 346/8 |
| 5,015,187 | A * | 5/1991 | Lord | 434/33 |
| 5,241,314 | A * | 8/1993 | Keeler et al. | 342/54 |
| 5,331,413 | A * | 7/1994 | Diner | 348/159 |
| 5,581,250 | A * | 12/1996 | Khvilivitzky | 340/961 |
| 5,838,636 | A * | 11/1998 | Ashford et al. | 367/95 |
| 5,904,724 | A * | 5/1999 | Margolin | 701/120 |
| 6,366,533 | B1 * | 4/2002 | English | 367/131 |
| 2003/0098799 | A1 * | 5/2003 | Zimmerman | 340/854.6 |
| 2004/0105344 | A1 * | 6/2004 | Davies et al. | 367/134 |
| 2005/0017873 | A1 * | 1/2005 | Liu et al. | 340/870.01 |
| 2005/0110869 | A1 * | 5/2005 | Tillotson | 348/113 |
| 2005/0279270 | A1 * | 12/2005 | Wingett et al. | 114/312 |
| 2006/0008137 | A1 * | 1/2006 | Nagahdaripour et al. | 382/154 |
| 2006/0286931 | A1 * | 12/2006 | Rhodes et al. | 455/40 |
| 2008/0042869 | A1 * | 2/2008 | Zimmerman | 340/853.2 |

OTHER PUBLICATIONS

Antonelli, G.; Chiaverini, S.; Finotello, R.; Schiavon, R. "Real-time path planning and obstacle avoidance for RAIS: an autonomous underwater vehicle" Oceanic Engineering, IEEE Journal of (0364-9059) 2001. Vol. 26,Iss.2;p. 216-227.*

Eustice, R.M.; Pizarro, O.; Singh, H. "Visually Augmented Navigation for Autonomous Underwater Vehicles" Oceanic Engineering, IEEE Journal of (0364-9059) 2008. Vol. 33,Iss.2;p. 103-122.*

Kinsey, J.C.; Whitcomb, L.L. "In Situ Alignment Calibration of Attitude and Doppler Sensors for Precision Underwater Vehicle Navigation: Theory and Experiment" Oceanic Engineering, IEEE Journal of (0364-9059) 2007. Vol. 32,Iss.2;p. 286-299.*

McEwen, R.; Thomas, H.; Weber, D.; Psota, F. "Performance of an AUV navigation system at Arctic latitudes" Oceanic Engineering, IEEE Journal of (0364-9059) 2005. Vol. 30,Iss.2;p. 443-454.*

* cited by examiner

*Primary Examiner* — Thomas Tarcza
*Assistant Examiner* — James Hulka
(74) *Attorney, Agent, or Firm* — Paul Davis; Goodwin Procter LLP

(57) ABSTRACT

The present invention relates to an underwater guidance system for guiding an underwater apparatus, for example an underwater vehicle, towards a target structure, such as a docking station. The system comprises at least one system for capturing or sensing information on the relative position of the apparatus and the target structure and/or at least one imaging system for capturing an image of the target structure and a transmitter for wireless electromagnetic transmission of data indicative of the position information and/or captured image to the underwater apparatus or an underwater apparatus controller.

26 Claims, 7 Drawing Sheets

- - Prior Art - -

UNDERWATER VEHICLE GUIDANCE

CROSS-REFERENCE TO RELATED APPLICATION

This application claims the benefit of commonly owned GB0820097.4 filed Nov. 3, 2008, which application is fully incorporated herein by reference.

INTRODUCTION

The present invention relates to an underwater guidance system and in particular an underwater video guided manoeuvring aid system.

BACKGROUND

Underwater vehicles are often used to carry out tasks through interaction with deployed equipment. Underwater vehicles may be remotely operated, often from the surface, by means of a wired communications link. This class of vehicle is termed a "Remotely Operated Vehicle" or ROV. Alternatively a vehicle may follow a pre-determined mission controlled by means of on board sensors and this type of vehicle is often classed as an "Autonomous Underwater Vehicle" AUV. A third class of underwater vehicle may be manned and under the local manual operator control.

To facilitate underwater interaction with deployed equipment existing equipment uses a video camera located on the vehicle that relays moving video to a ROV operator or provides guidance to an AUV through use of computer vision techniques. FIG. 1 shows a conventional underwater vehicle docking arrangement. Remotely operated vehicle 10 is equipped with a forward looking video camera 11 that relays images to the control station through wired communications link 12. The vehicle moves in the direction indicated by arrow 13 towards docking loop 14 attached to remotely deployed equipment 15. On board camera 11 gives a useful guiding image for port, starboard and elevation positioning but not closing range and does not provide a representation of the vehicle it is mounted to.

SUMMARY OF INVENTION

According to the present invention, there is provided an underwater guidance system for guiding an underwater apparatus, for example an underwater vehicle, towards a target structure, such as a docking station. The system comprises at least one system for capturing or sensing information on the relative position of the apparatus and the target structure and/or at least one imaging system for capturing an image of the target structure and a transmitter for wireless electromagnetic transmission of data indicative of the position information and/or captured image to the underwater apparatus or an underwater apparatus controller.

In one example implementation, cameras are placed to provide a side on view of an underwater vehicle's position relative to a docking station and video images are transmitted back to the manoeuvring vehicle by means of a wireless radio link. This allows the operator to judge the vehicle approach from diverse angular images to better facilitate a controlled approach while wireless transmission ensures the vehicle's motion is not encumbered by the cabled video links required by an alternative connected system. Radio modems can be configured to provide bidirectional transceiver communications functionality. This capability allows control of remote camera operational parameters, for example, pan; zoom; tilt; focus; frame rate; picture quality.

A distributed wireless camera system can be used to establish the relative positioning of a vehicle relative to deployed equipment. All six spatial degrees of freedom may be used to describe relative position; x, y, z offset; roll, pitch and yaw. This positioning data could be communicated to the controlling station either visually in the form of images or as a numerical description of relative position.

According to one aspect of the present invention, there is provided an underwater guidance system comprising wireless transmission equipment that relays images from remotely deployed cameras to an underwater vehicle. Images are carried using an electromagnetic communications channel and signals are transmitted from the underwater vehicle to implement control of a remotely deployed camera or multiple cameras.

In some applications still images or a succession of still images may be sufficient to facilitate the required vehicle operations. The presently described system will be illustrated using the example application of a vehicle docking scenario but may find broader use as a more general aid to underwater working. For example to provide an alternate view of work using a robotic manipulating arm commonly found in underwater "intervention" vehicles. According to another aspect of the present invention, there is provided an underwater vehicle guidance system that employs a digital modulation scheme to carry communications data between the mobile and fixed stations in either direction The radio modems associated with each camera may be configured as transmitters to send video images to the vehicle or as transceiver units to allow control of the cameras. Vehicle modems may correspondingly be implemented as receivers or transceivers to facilitate video reception and/or command communications.

For a given video transmission data rate image quality is a trade off against frame rate. In some applications it will be beneficial to make use of the available communications bandwidth to effectively relay a series of still images at higher image resolution.

Remote cameras may be deployed to provide a side view and/or rear view and/or vertical view of the vehicle's motion relative to the docking station.

BRIEF DESCRIPTION OF DRAWINGS

Various aspects of the invention will now be described by way of example only and with reference to the accompanying drawings, of which.

DETAILED DESCRIPTION OF THE DRAWINGS

Figure 1:
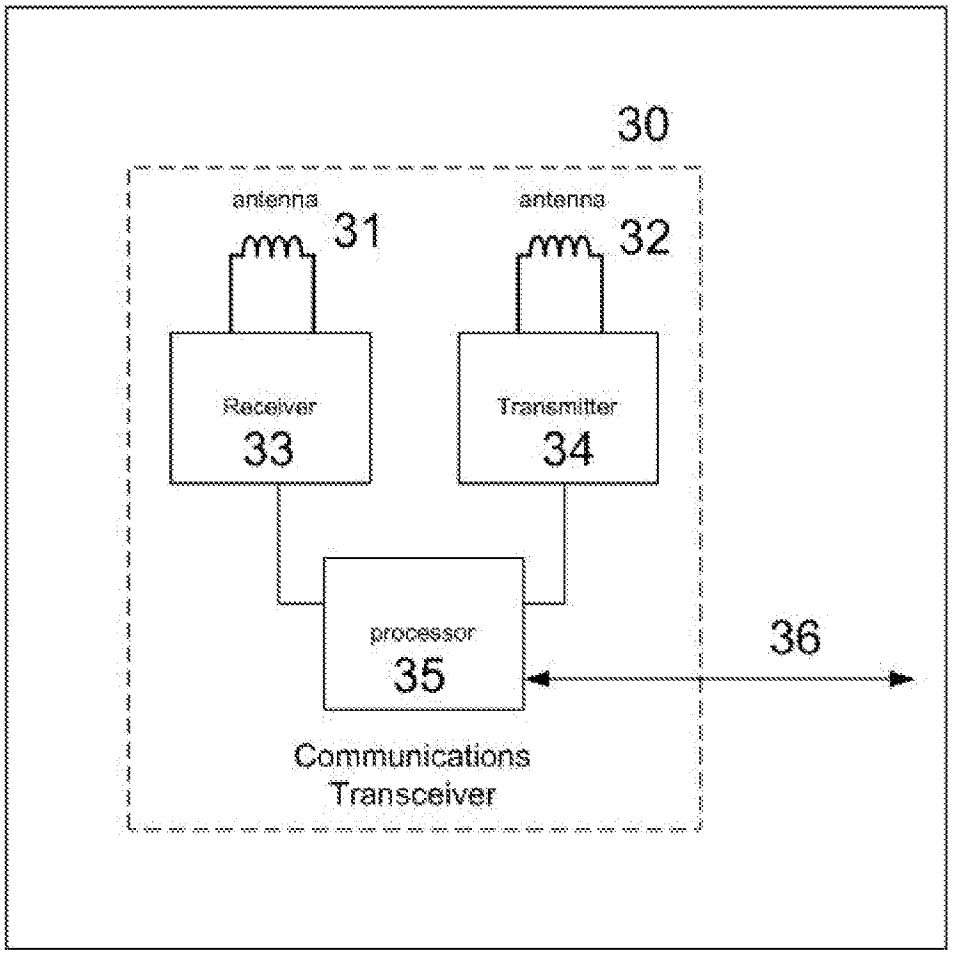
FIG. 1 shows a conventional underwater vehicle docking arrangement.
Figure 2:
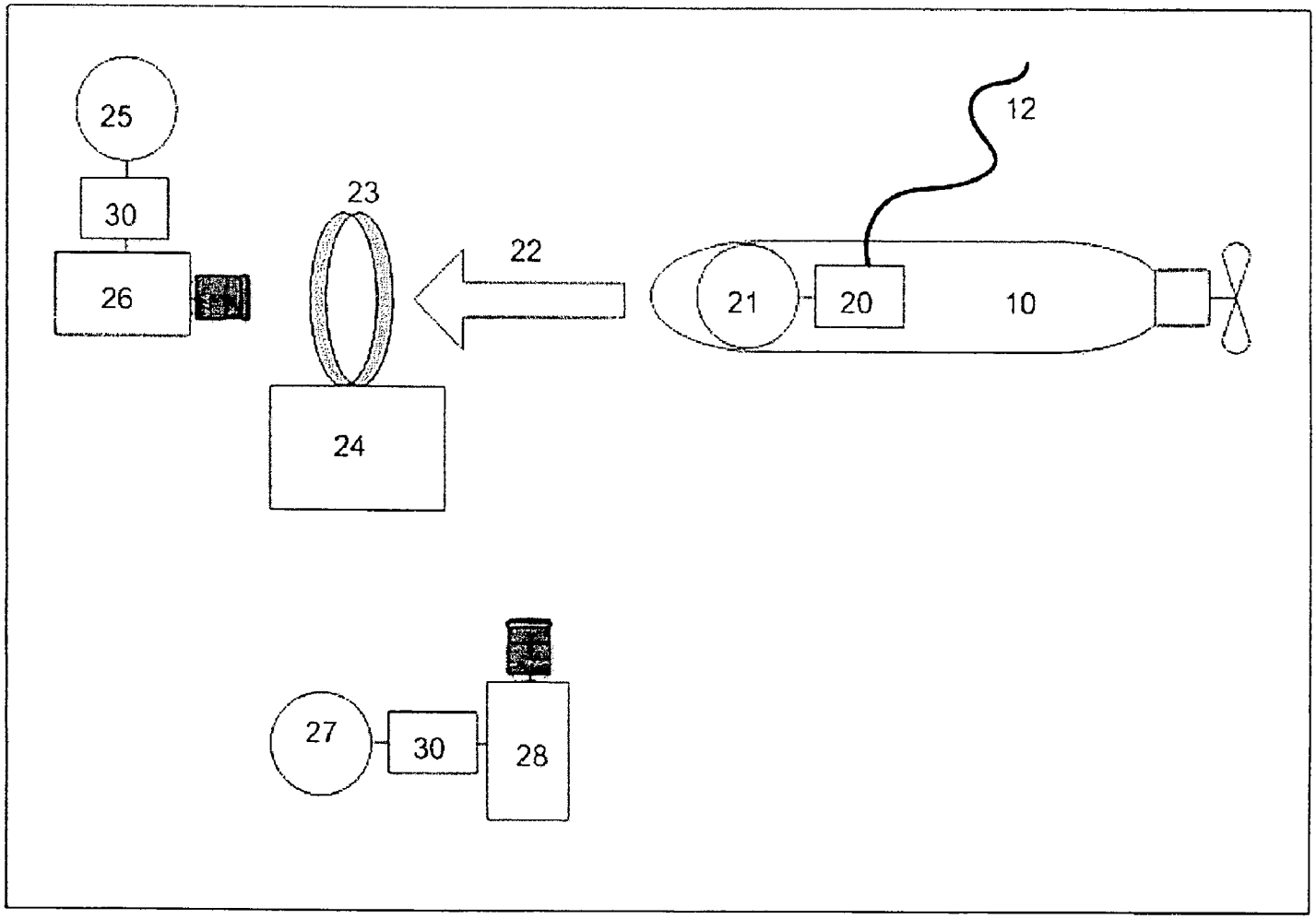
FIG. 2 shows an underwater vehicle docking with the aid of a remotely deployed camera system as described in this application.

FIG. 2 shows an underwater vehicle 10 docking with a docking structure 23. The docking structure 23 may be associated with any form of deployed equipment or any fixed or mobile underwater station. The vehicle 10 has a radio modem 20, which may be a receiver only or a transceiver, and associated loop antenna 21. The vehicle is manoeuvred in the direction represented by arrow 22 to complete docking with the structure 23 connected to deployed equipment 24. Positioned behind the docking structure 23, but with a view of the vehicle approach, is a first camera 26. To the side of the structure 23 is a second camera 28 positioned to capture a view that is roughly perpendicular to the direction of approach.

Cameras 26 and 28 are equipped with radio modems 30 and associated antennas 27 and 25 to enable through water wireless transmission of video images. The radio modems 30 may be transmit only or combined transceivers. Radio modem 20 receives video transmissions from remote cameras 26 and 28, which are relayed through cable 12 to the vehicle control station. In this system, the remotely deployed cameras 26, 28 provide three-dimensional guidance of the docking operation. When the modem 30 is a transceiver a separate receiver is provided, camera control information can be sent to the underwater vehicle for onward transmission via the modem 20 and antenna 21 to camera modems 30 to allow remote control of camera parameters for example pan, zoom, tilt, focus, frame rate, picture quality.

The cameras 26, and 28 are positioned in such a manner as to allow capture of a three-dimensional image of the docking station. To this end, one of the cameras 28 is positioned roughly perpendicular to the direction of approach to present a side view of the vehicle moving towards docking station 23 to allow visualisation of closing range. A similar view could be provided looking down and/or up to the manoeuvring vehicle. The other camera 26 views from the target docking structure 23 to the manoeuvring vehicle to provide port; starboard; up; down alignment guidance during the docking process.

Figure 3:
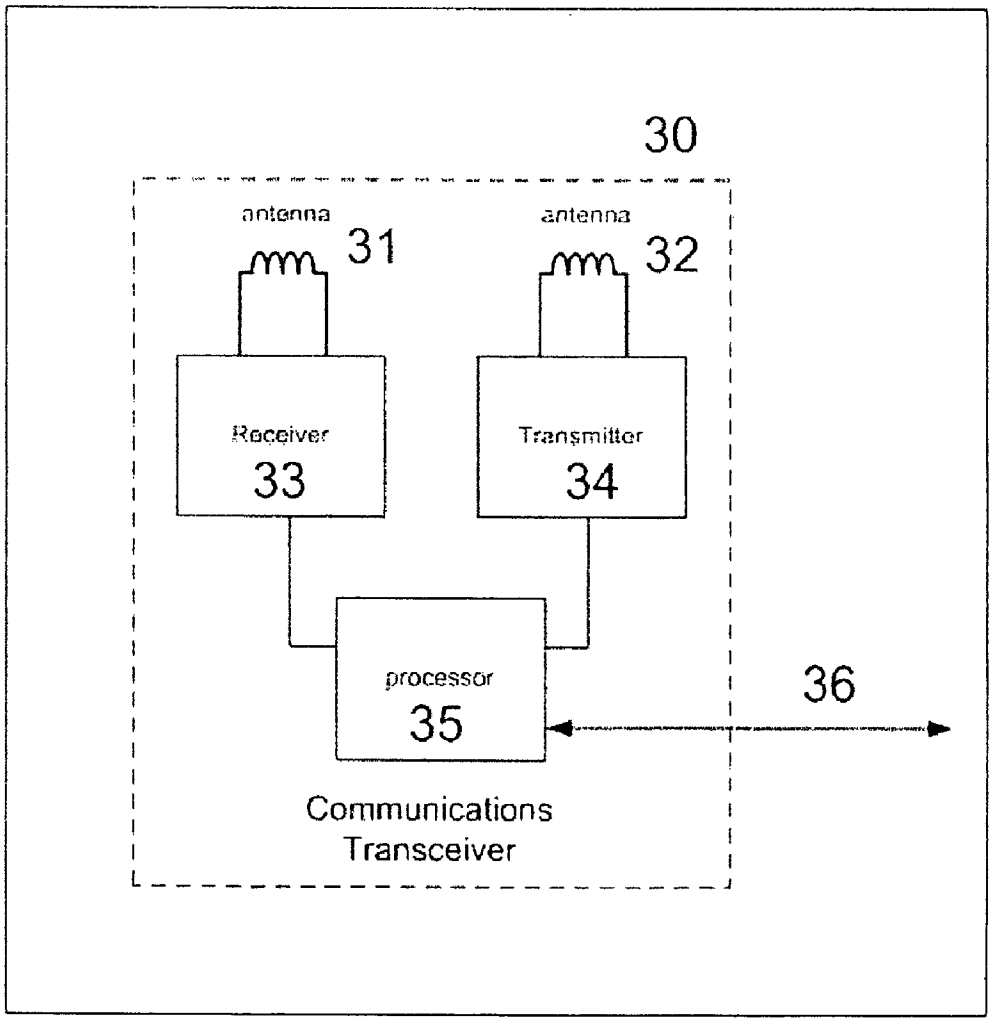
FIG. 3 shows a known underwater radio transceiver suitable for use as transceivers 30 and 20 in FIG. 2.

FIG. 3 shows a known underwater radio transceiver suitable for use with the cameras 26, 28 and underwater vehicle 10 of the system of FIG. 2. This has a receive antenna 31 that acts as a transducer to convert the electromagnetic signal in the water into an electrical potential at the receiver 33 input. Antenna 31 may be implemented as a multi-turn loop antenna. Connected to the receive antenna is a receiver 33 that performs signal conditioning and processing to extract the video data from the modulated received signal. Received video data is passed to microprocessor 35 for framing and formatting for onward transmission over a data interface 36 to interface with a camera or umbilical connection 12 in the case of the underwater vehicle modem. For the transmitters at the cameras 26, 28, the processor 35 may implement a video compression algorithm to reduce the radio signal bandwidth required to communicate a given frame rate signal.

Also included in the transceiver is a transmit antenna 32, which may consist of a multi-turn loop antenna, that is connected to a transmitter 34. Data supplied over data interface 36 is formatted by microprocessor 35 and a serial data stream passed to transmitter 34, which modulates a carrier signal with either analogue or digital encoded information to convey the video image. The amplified signal produced by transmitter 34 is supplied to antenna 32, for transduction into an electromagnetic signal carried over the water.

Several classes of antenna are suitable for use in system of FIG. 2. For example, multi-turn loop antennas for launching and recovering an electromagnetic signal through magnetic coupling. In some cases a single turn loop may be more efficient. Solenoid wound antennas can also be used and here the solenoid is typically wound around a high permeability and low electrical conductivity core material with a relative permeability of typically greater than 10. A third class of transducer is available in sea water applications where the higher water conductivity lends itself to supporting direct electrical contact with the driving transmitter or receiver input. Two electrically conductive plates may make contact with the seawater and here it is beneficial to space the two plates as far apart as is practical in a given deployment.

Figure 4:
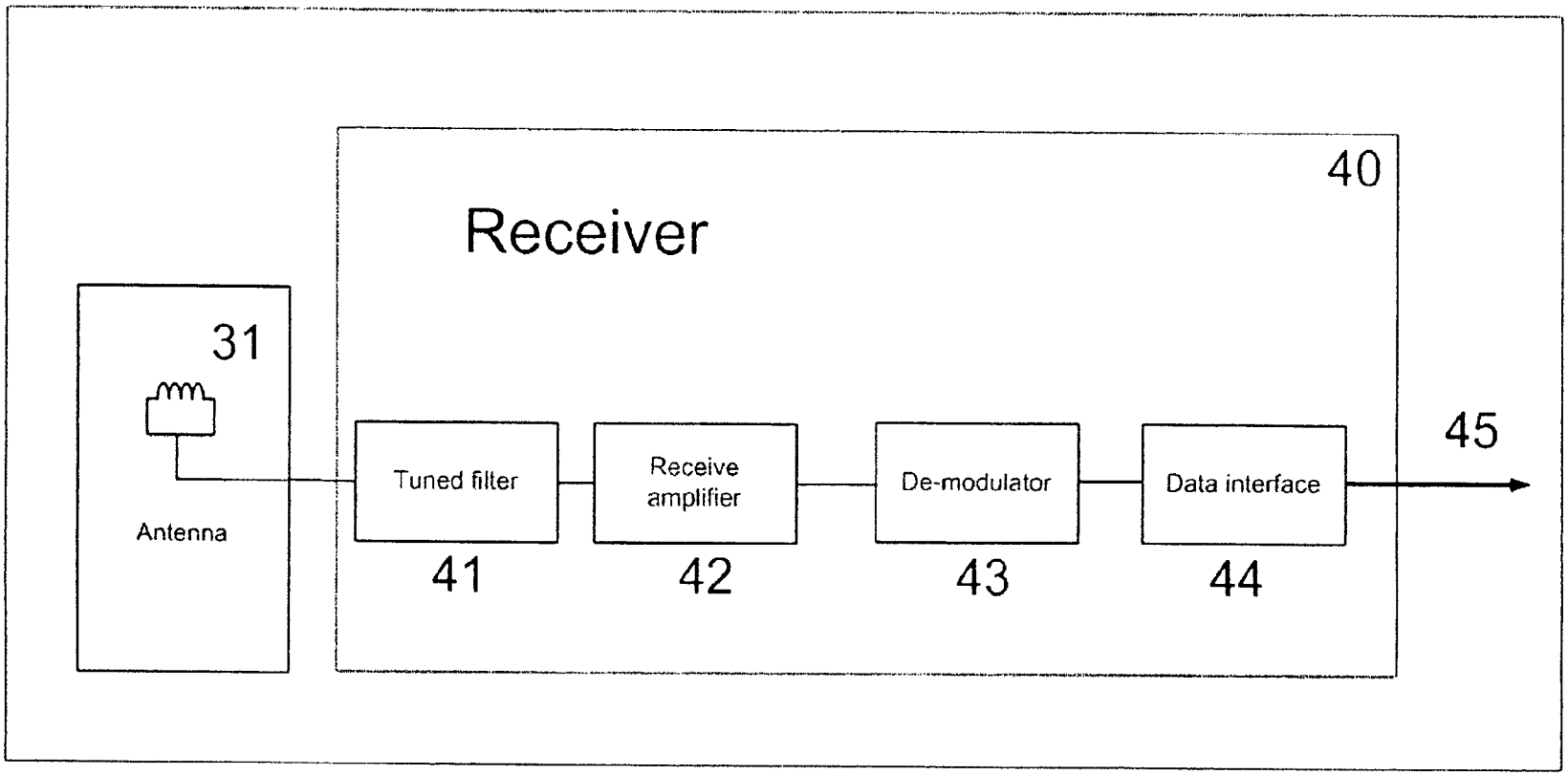
FIG. 4 shows a block diagram representation of the receive component of the transceiver in FIG. 3.

FIG. 4 shows the receiver 33 of the transceiver in FIG. 3 in more detail. The receive antenna 31 passes the received signal to tuned filter 41 which restricts the received bandwidth to improve the received signal to noise ratio. A receive amplifier 42 increases the received signal magnitude and a de-modulator 43 extracts the data stream from the modulated carrier. A data interface 44 passes data to the transceiver processor via serial data link 45.

Figure 5:
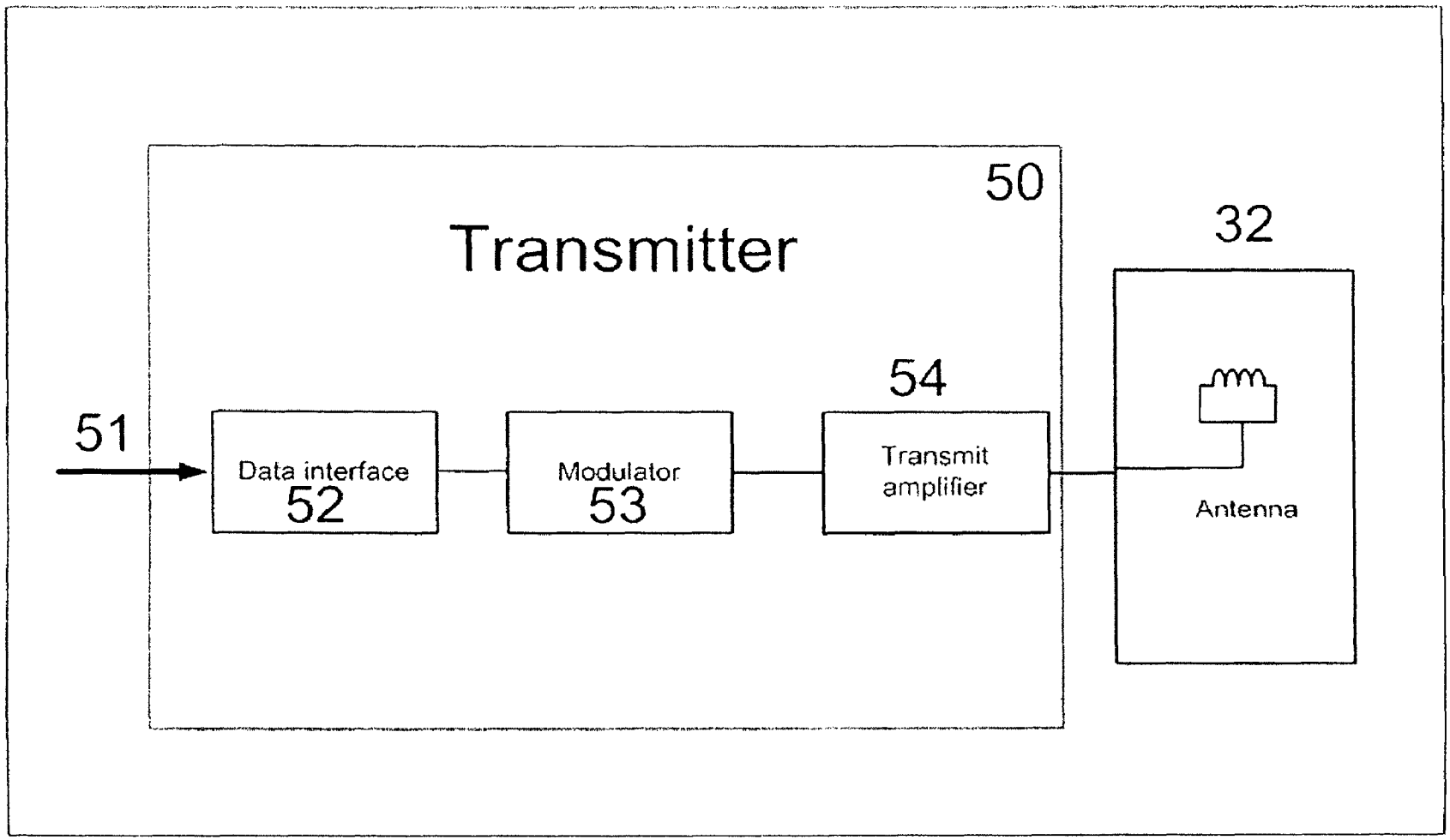
FIG. 5 shows a block diagram of the transmitter component of the transceiver in FIG. 3.

FIG. 5 shows the transmitter 34 of the transceiver in FIG. 3. Serial data is supplied from data processor 35 via serial data link 51 to data interface unit 52. Modulator 53 encodes data onto a carrier signal and transmit amplifier supplies an increased amplitude signal to transmit antenna 32.

Seawater has a conductivity of around 4,000 mS/m, which is many times that of nominally fresh water (variable e.g. 10 mS/m). Subsea video transmission will typically be achieved using carrier frequencies below 20 MHz. At these comparatively low frequencies the antenna classes previously described are beneficial compared to other antenna types since they can produce sufficient transmit and receive transducer efficiency while occupying practical physical dimensions.

Figure 6:
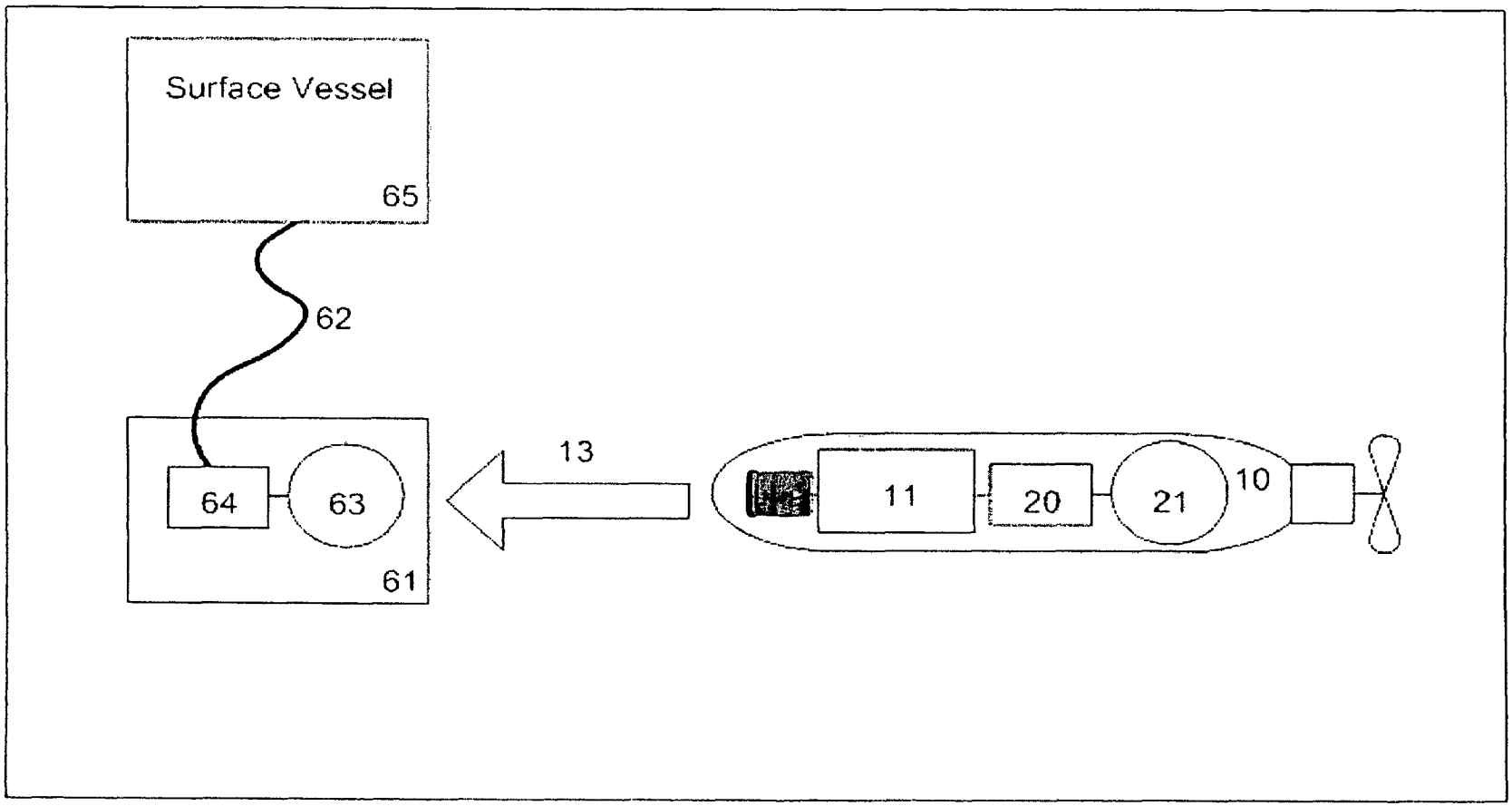
FIG. 6 is alternative configuration wherein a remote camera is located on an underwater vehicle to aid docking to a controlling station and FIG. 7 shows an alternative configuration wherein a remote camera system is arranged to provide guidance for movement of a manipulator arm.

FIG. 6 shows another docking system, in which a remote camera 11 is located on an underwater vehicle 10 to aid docking to a manned submarine 61 or surface vessel 65 or, more generally, a controlling station. A radio video link relays video images from the underwater vehicle to the controlling station to aid docking either by guiding movement of the remote vehicle through a return control channel or guiding movement of the submarine or surface vessel. The camera 11 located on the underwater vehicle sends video images to radio modem 20 for transmission through the antenna 21. The underwater vehicle moves relative to the controlling station in direction represented by vector 13 towards a submerged vehicle or docking station 61. Antenna 63 receives the electromagnetic signal, which is processed by radio modem 64. Video data and control commands are passed from the modem 64 to a control vessel 65, for example a surface vessel, via an umbilical cable 62. Control signals from the vessel 65 to the underwater vehicle 10 are also transmitted via the cable 62 and forwarded to the vehicle 10 via antenna 63.

The electromagnetic signal is received by the antenna 21 and processed by modem 20 to produce control information to command vehicle movements. In an alternative implementation, the control station is located at the submerged vehicle or docking station 61, rather than in the surface vehicle 65.

Figure 7:
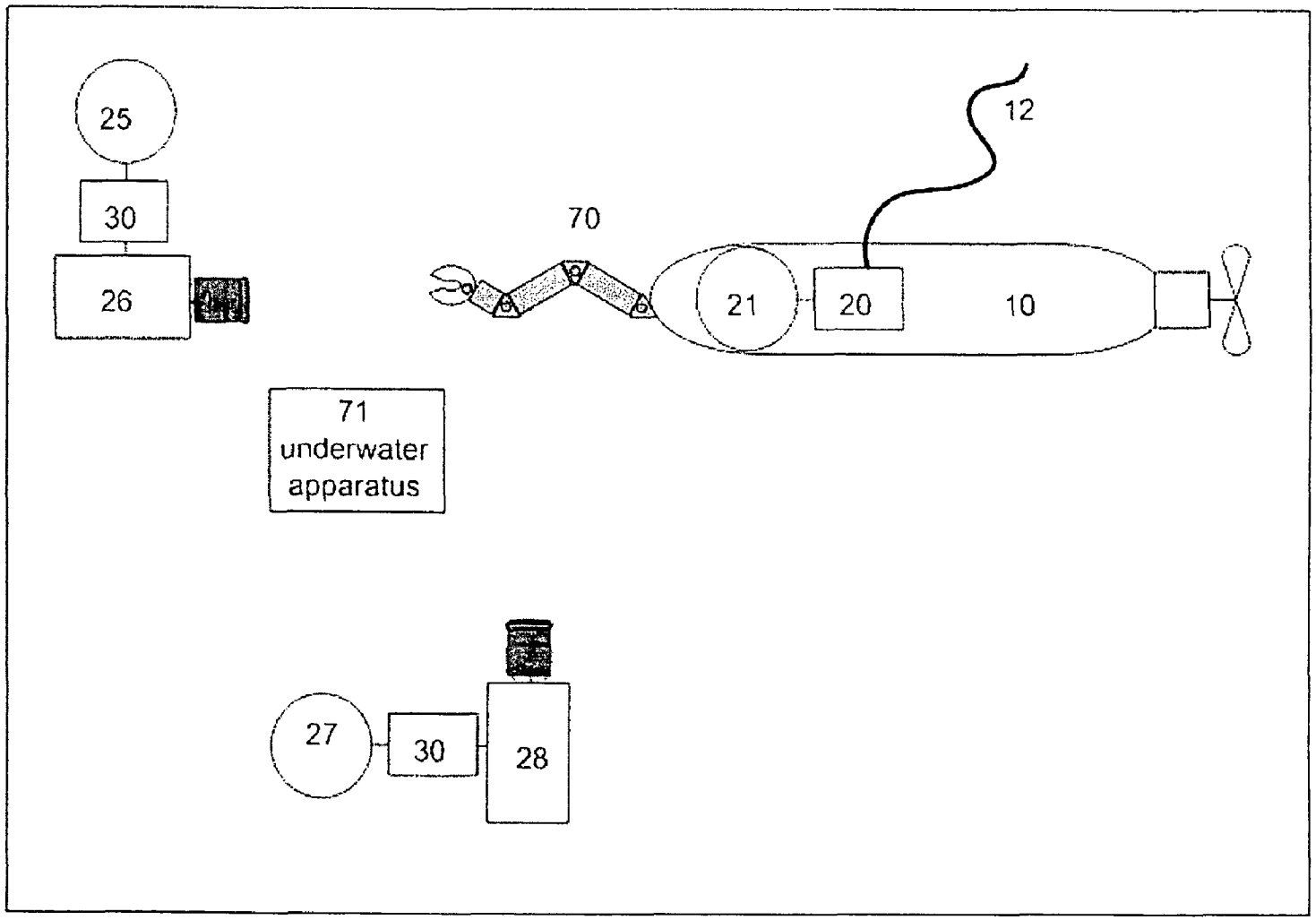

FIG. 7 shows a guidance system for guiding movement of a manipulator arm 70 attached to an underwater vehicle 10 that interacts with subsea apparatus 71. The vehicle 10 is fitted with a radio modem 20, which may be a receiver only or a transceiver, and associated loop antenna 21. Positioned behind the apparatus 71, but with a view of the vehicle approach, is a first camera 26. To the side of the apparatus 71 is a second camera 28 positioned to capture a view that is roughly perpendicular to the view provided by camera 26.

As for the system of FIG. 2, cameras 26 and 28 are equipped with radio modems 30 and associated antennas 27 and 25 to enable through water wireless transmission of video images. The radio modems 30 may be transmit only or combined transceivers. Radio modem 20 receives video transmissions from remote cameras 26 and 28, which are relayed through cable 12 to an arm control station, which may be in the vehicle or remotely located but connected by an umbilical cable. In this system, the remotely deployed cameras 26, 28 provide three-dimensional guidance of the arm manipulation. Camera control information can also be sent to the underwater vehicle for onward transmission via the modem 20 and antenna 21 to camera modems 30 to allow remote control of camera parameters for example pan, zoom, tilt, focus, frame rate, picture quality.

While electromagnetic signals of sufficient bandwidth to support video images experience relatively high attenuation in water, communication will be possible over several meters and this range is commensurate with the requirements of vehicle close range guidance. One potential advantage of this limited range is that it allows frequency re-use at relatively close range. For example a second vehicle and docking installation can operate simultaneously at only 10 m separation from a first station without any interference between communicating channels.

As well as providing visual images, the systems described above may be used to make a quantitative measurement of the distance separating a manoeuvring vehicle or apparatus and a target structure then to communicate this measurement to a controlling station, rather than full image data. This data can be conveyed within a far smaller signal bandwidth than a video image. In underwater radio applications a smaller bandwidth signal can be transmitted using a lower carrier frequency and this leads to greatly increased communications range. More generally, a number of distributed cameras can be arranged to communicate data to a central processor by wired or wireless connection. The central processor can run computer vision algorithms to establish the manoeuvring vehicle's three dimensional relative position in space including x, y, z offset and roll, pitch and yaw. This telemetry data could be communicated to the vehicle or apparatus controlling station.

While video cameras have been described above, as a means of gathering positional data, any other suitable sensor or imaging system may be deployed. For example, an array of light or acoustic beams could be set up that are progressively interrupted as a vehicle approaches. A sonar imaging system will be advantageous in place of cameras in some implementations particularly in areas with high turbidity.

The cameras, modems and equipment associated with the remotely deployed underwater equipment may lie idle for periods of time between visits by the underwater vehicle. It will be beneficial for this equipment to remain in a low power mode but with the capability of reverting to an active mode on demand from the underwater vehicle. This may be initiated by means of a radio signal transmitted from the AUV or ROV or alternatively signalled by a light source on the AUV or ROV. A minimal radio or photonic receiver function can be maintained in a powered state at the deployed station to detect this initiating signal then power up the full transceiver functionality.

Those familiar with communications and sensing techniques will understand that the foregoing is but one possible example of the principle according to this invention. In particular, to achieve some or most of the advantages of this invention, practical implementations may not necessarily be exactly as exemplified and can include variations within the scope of the invention. For example, where an ROV is referred to in the text for convenience the manoeuvring vehicle may be any other class of underwater vehicle. Also, whilst the systems and methods described are generally applicable to seawater, fresh water and any brackish composition in between, because relatively pure fresh water environments exhibit different electromagnetic propagation properties from saline, seawater, different operating conditions may be needed in different environments. Any optimisation required for specific saline constitutions will be obvious to any practitioner skilled in this area. Accordingly the above description of the specific embodiment is made by way of example only and not for the purposes of limitation. It will be clear to the skilled person that minor modifications may be made without significant changes to the operation described.

The invention claimed is:

1. An underwater guidance system for guiding an underwater apparatus towards a target structure, the system comprising at least one positioning system for capturing information on the relative position of the apparatus and the target structure and at least one imaging system for capturing an image of the target structure wherein each at least one positioning system and at least one imaging system is provided with a transmitter for wireless electromagnetic transmission of data indicative of the position information and/or captured image to the underwater apparatus or an underwater apparatus controller to facilitate guidance of the underwater apparatus towards the target structure and at least one of said at least one positioning system and at least one imaging system is located remote to the underwater apparatus.

2. A system as claimed in claim 1 wherein the at least one imaging system is positioned to provide a side view and/or rear view and/or vertical view of the target structure.

3. A system as claimed in claim 1 wherein a plurality of imaging systems is provided and arranged to give a three dimensional image of the target structure.

4. A system as claimed in claim 1 wherein transmitter is operable to use one or more carrier frequencies below 20 MHz.

5. A system as claimed in claim 1 comprising a receiver associated with the positioning and/or imaging system.

6. A system as claimed in claim 5 comprising wherein the receiver is operable to receive control signal for controlling the positioning and/or imaging system.

7. A system as claimed in claim 5 wherein the receiver is a radio modem.

8. A system as claimed in claim 1 wherein a digital modulation scheme is employed by the transmitter to transmit the video data.

9. A system as claimed in claim 1 wherein the transmitter comprises a radio modem.

10. A system as claimed in claim 1 wherein the transmitter includes a multi-turn loop antenna.

11. A system as claimed in claim 1 wherein transmitter includes a multi-turn solenoid antenna wound around a core, preferably wherein the core has a relative permeability greater than 10.

12. A system as claimed in claim 1 wherein transmitter includes an antenna that comprises a two electrode direct conductive contact with the seawater medium.

13. A system as claimed in claim 1 wherein a microprocessor associated with the imaging system implements a video compression algorithm to reduce the signal transmitted bandwidth.

14. A system as claimed in claim 1 comprising activation means for activating the at least one imaging system in response to an initiating signal.

15. A system as claimed in claim 14 wherein the initiating signal is one of a radio signal or an optical signal from the underwater apparatus.

16. A system as claimed in claim 1 wherein the at least one imaging system is mobile.

17. A system as claimed in claim 16 wherein the imaging system is located on an underwater vehicle, such as an AUV or ROV.

18. A system as claimed in claim 1 wherein the imaging system comprises at least one camera and/or at least one optical imager, for example that use a plurality of light beams, and/or at least one sonar imaging system.

19. A system as claimed in claim 18 wherein the camera is operable to capture a video or still image of the target structure.

20. A system as claimed in claim 18 comprising information transmission means operable to facilitate controlling pan and/or tilt and/or zoom and/or focus of the camera.

21. A system as claimed in claim 1 wherein the positioning system and/or imaging system are located in the underwater apparatus and apparatus controller is located remotely from the apparatus and information is communicated using the wireless transmitter.

22. A system as claimed in claim 1 wherein the information communicated to the underwater apparatus controller facilitates guiding the underwater apparatus towards the target structure in response to the position and/or image information.

23. A system as claimed in claim 1 wherein the underwater apparatus is an underwater vehicle.

24. A system as claimed in claim 1 wherein the underwater apparatus is a movable device, for example manipulator arm.

25. A system as claimed in claim 24 wherein the movable arm is mounted on an underwater vehicle.

26. A system as claimed in claim 1 wherein the target structure is a docking system.

* * * * *